US009355634B2

(12) United States Patent
Iriyama

(10) Patent No.: US 9,355,634 B2
(45) Date of Patent: May 31, 2016

(54) VOICE SYNTHESIS DEVICE, VOICE SYNTHESIS METHOD, AND RECORDING MEDIUM HAVING A VOICE SYNTHESIS PROGRAM STORED THEREON

(71) Applicant: Yamaha Corporation, Hamamatsu-Shi, Shizuoka-Ken (JP)

(72) Inventor: Tatsuya Iriyama, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 89 days.

(21) Appl. No.: 14/198,464

(22) Filed: Mar. 5, 2014

(65) Prior Publication Data

US 2014/0278433 A1 Sep. 18, 2014

(30) Foreign Application Priority Data

Mar. 15, 2013 (JP) ..... 2013-052758

(51) Int. Cl.
*G10L 13/033* (2013.01)
*G10L 13/02* (2013.01)

(52) U.S. Cl.
CPC ..... *G10L 13/033* (2013.01); *G10L 13/02* (2013.01); *G10H 2250/315* (2013.01); *G10H 2250/455* (2013.01)

(58) Field of Classification Search
CPC ..... G10H 2250/455; G10L 13/033
See application file for complete search history.

(56) References Cited

U.S. PATENT DOCUMENTS 4,731,847 A * 3/1988 Lybrook ..... G10H 5/005 704/260
5,642,470 A * 6/1997 Yamamoto ..... G10L 13/033 704/258

(Continued)

FOREIGN PATENT DOCUMENTS

JP 2002-268664 A 9/2002
JP 2005-181840 A 7/2005

(Continued)

OTHER PUBLICATIONS

Abe, M. et al. (2001). "A Bilingual Speech Design Tool: Sesign," ISCA Archive, NTT Cyber Space Laboratories, Kanagawa, Japan, located at: http://www.isca_speech.org/archive, five pages.

(Continued)

*Primary Examiner* — Douglas Godbold
(74) *Attorney, Agent, or Firm* — Morrison & Foerster LLP

(57) ABSTRACT

A voice synthesis device includes a sequence data generation unit configured to generate sequence data including a plurality of kinds of parameters for controlling vocalization of a voice to be synthesized based on music information and lyrics information, an output unit configured to output a singing voice based on the sequence data, and a processing content information acquisition unit configured to acquire a plurality of processing content information, associated with each of pieces of preset singing manner information. Each of the content information indicates contents of edit processing for all or part of the parameters. The sequence data generation unit generates a plurality of pieces of sequence data, and the sequence data are obtained by editing the all or part of the parameters included in the sequence data, based on the content information associated with one of the pieces of singing manner information specified by a user.

19 Claims, 10 Drawing Sheets

(56) References Cited

U.S. PATENT DOCUMENTS

| | | | | |
|---|---|---|---|---|
| 5,703,311 | A * | 12/1997 | Ohta | G10H 7/10 704/209 |
| 5,895,449 | A * | 4/1999 | Nakajima | G10H 7/002 704/258 |
| 6,424,944 | B1 * | 7/2002 | Hikawa | G10L 13/08 704/258 |
| 2003/0221542 | A1 * | 12/2003 | Kenmochi | G10H 7/002 84/616 |
| 2004/0186720 | A1 * | 9/2004 | Kemmochi | G10H 5/00 704/258 |
| 2004/0193429 | A1 * | 9/2004 | Kimoto | G10H 1/0083 704/278 |
| 2009/0259475 | A1 * | 10/2009 | Yamagami | G10L 13/10 704/276 |
| 2009/0306987 | A1 * | 12/2009 | Nakano | G10H 1/366 704/260 |
| 2010/0250254 | A1 * | 9/2010 | Mizutani | G10L 13/08 704/260 |
| 2012/0310643 | A1 * | 12/2012 | Labsky | G10L 13/08 704/260 |
| 2013/0019738 | A1 * | 1/2013 | Haupt | G10H 1/06 84/622 |
| 2013/0151256 | A1 * | 6/2013 | Nakano | G10L 13/033 704/268 |
| 2014/0046667 | A1 * | 2/2014 | Yeom | G10L 13/033 704/258 |

FOREIGN PATENT DOCUMENTS

| | | | |
|---|---|---|---|
| JP | 2013-011828 | A | 1/2013 |
| WO | WO-2007/010680 | A1 | 1/2007 |

OTHER PUBLICATIONS

Abe, M. et al. (Jun. 1, 2001). "Speech Design Tool: Sesign," vol. J84-D-II, No. 6, pp. 927-935, In Japanese language, nine pages.

Japanese Office Action dated Mar. 24, 2015, for JP Patent Application No. 2013-052758, with partial English translation, four pages.

European Search Report dated Aug. 21, 2014, for EP Application No. 14157748.6, eight pages.

* cited by examiner

FIG.4

| SINGING MANNER IDENTIFIER | PROCESSING CONTENT DATA |
|---|---|
| ARTICULATE CONSONANT | METHOD A: DECREASE VELOCITY |
| | METHOD B: INCREASE VOLUME OF CONSONANT |
| | METHOD C: DECREASE PITCH OF CONSONANT |
| | |

FIG.6A

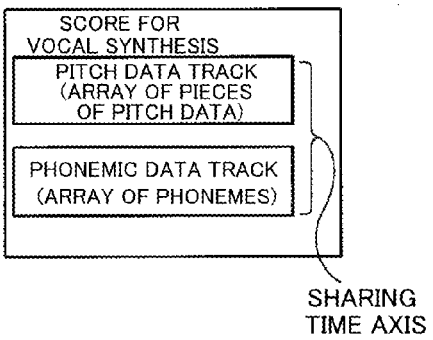

FIG.6B

EXAMPLE OF XML-FORMAT SEQUENCE DATA:
("MAE" PART OF LYRICS)

```
<note>
 <posTick>4650</posTick>
 <durTick>240</durTick>
 <noteNum>66</noteNum>
 <velocity>64</velocity>
 <lyric><![CDATA[MA]]></lyric>
 <phnms><![CDATA[m a]]></phnms>
 <noteStyle>
  <attr id="accent">50</attr>
 </noteStyle>
</note>
<note>
 <posTick>4890</posTick>
 <durTick>240</durTick>
 <noteNum>66</noteNum>
 <velocity>64</velocity>
 <lyric><![CDATA[ E ]]></lyric>
 <phnms><![CDATA[e]]></phnms>
 <noteStyle>
  <attr id="accent">50</attr>
 </noteStyle>
</note>
···(OMITTED)
```

D1[t]=k(t)×D0[t]

P1[t]=P0[t]-k(t)

B1[t]=n(t)

VOICE SYNTHESIS DEVICE, VOICE SYNTHESIS METHOD, AND RECORDING MEDIUM HAVING A VOICE SYNTHESIS PROGRAM STORED THEREON

CROSS-REFERENCE TO RELATED APPLICATION

The present application claims priority from Japanese Application JP2013-052758. The content of the application is hereby incorporated by reference into this application.

BACKGROUND OF THE INVENTION

1. Field of the Invention

The present invention relates to a voice synthesis device, a voice synthesis method, and a recording medium having a voice synthesis program stored thereon.

2. Description of the Related Art

Examples of a voice synthesis technology of this kind include a vocal synthesis technology for electronically synthesizing a singing voice based on information indicating a string of notes composing a melody of a piece of music (in other words, information indicating a change in rhythm of a melody; hereinafter referred to as "music information") and information indicating lyrics to be vocalized in synchronization with the respective notes (information indicating a phoneme string composing lyrics; hereinafter referred to as "lyrics information") (see, for example, WO2007/010680, Japanese Patent Application Laid-open No. 2005-181840, and Japanese Patent Application Laid-open No. 2002-268664). In recent years, application software for causing a general computer such as a personal computer to perform such vocal synthesis is widely distributed. Examples of the application software of this kind include a set of a vocal synthesis program and a database for vocal synthesis storing pieces of waveform data on various phonemes which are extracted from voices of a voice actor or a singer.

The vocal synthesis program is a program for causing the computer to execute processing for reading the pieces of waveform data on the phonemes designated by the lyrics information from the database for vocal synthesis, subjecting each piece of waveform data to pitch conversion so as to achieve a pitch designated by the music information, and combining the pieces of waveform data in pronunciation order, to generate the waveform data indicating a sound waveform of the singing voice. Further, in some vocal synthesis programs, not only the phoneme string which composes lyrics and pitches exhibited when the lyrics are pronounced, but also various parameters which indicate a vocalization manner of a voice such as velocities and volumes exhibited when the lyrics are pronounced, can be designated finely in order to obtain a natural singing voice that is close to a human singing voice.

SUMMARY OF THE INVENTION

When a singing voice of a singer is recorded to produce a CD or the like, the recording may include a "retake" in which the singer is made to sing repeatedly until a recording director or the like satisfies so as to record all or part of the singing voice again. In such a retake, the recording director or the like orders the singer to sing again by designating a time segment to be retaken (hereinafter referred to as "retake segment") and a singing manner (for example, "more softly" or "pronounce words clearly") for the retake segment, while the singer sings again through trial and error in order to realize the singing manner specified by the recording director or the like.

Also in vocal synthesis, it is naturally preferred that the singing voice be synthesized in a singing manner desired by a user of a vocal synthesis program. In the vocal synthesis, by editing each of various parameters defining a vocalization manner, it is possible to change a singing manner of a synthesized singing voice in the same manner as in the retake performed in the case where a human sings. However, from the viewpoint of a general user, he/she often has no idea about how to edit which parameter to realize the singing manner such as "more softly" and can hardly realize a desired singing manner. The same applies to a case where a voice other than the singing voice, such as a narrating voice for a literary work or a guidance voice for various kinds of guidance, is electronically synthesized based on information indicating a change in rhythm of a voice to be synthesized (information corresponding to the music information used in the vocal synthesis) and information indicating a substance to be vocalized (information corresponding to the lyrics information used in the vocal synthesis). In the following description, performing the voice synthesis again so as to realize a desired vocalization manner (in case of vocal synthesis, singing manner) in voice synthesis is also referred to as "retake".

One or more embodiments of the present invention has been made in view of the above-mentioned problems, and an object thereof is to provide a technology that enables a retake of a synthesized voice without directly editing various parameters indicating a vocalization manner of a voice.

(1) A voice synthesis device includes a sequence data generation unit configured to generate sequence data including a plurality of kinds of parameters for controlling vocalization of a voice to be synthesized based on music information and lyrics information. The voice synthesis device also includes an output unit configured to output a singing voice based on the sequence data and a processing content information acquisition unit configured to acquire a plurality of pieces of processing content information associated with each of pieces of preset singing manner information. Each of the plurality of pieces of processing content information indicates contents of edit processing for all or part of the plurality of kinds of parameters. The sequence data generation unit generates a plurality of pieces of sequence data. The plurality of pieces of sequence data are obtained by editing the all or part of the plurality of kinds of parameters included in the sequence data, based on the plurality of pieces of processing content information associated with one of the pieces of singing manner information specified by a user.

(2) In the voice synthesis device according to (1), the output unit outputs singing voices based on the plurality of pieces of sequence data in order.

(3) In the voice synthesis device according to (1), the sequence data generation unit further generates a plurality of pieces of sequence data. Each of the plurality of pieces of sequence data is obtained by editing the all or part of the plurality of kinds of parameters included in the sequence data, based on a combination of all or part of the plurality of pieces of processing content information associated with the one of the pieces of singing manner information specified by the user.

(4) In the voice synthesis device according to (2), each of the plurality of pieces of processing content information is further associated with priority information indicating a priority of outputting the singing voice by the output unit. The output unit outputs the singing voices based on the generated plurality of pieces of sequence data in order in accordance with the priority.

(5) In the voice synthesis device according to (4), the priority is updated based on an evaluation value for the edited sequence data input by the user.

(6) In the voice synthesis device according to (1), the output unit outputs only the singing voice based on a generated piece of sequence data including the edited parameters, which has a difference between the singing voice output based on the generated piece of sequence data and the singing voice output based on the sequence data prior to the editing, among the generated plurality of pieces of sequence data. The difference is equal to or larger than a predetermined threshold value.

(7) In the voice synthesis device according to (1), the sequence data generation unit generates only part of the plurality of pieces of sequence data based on a phoneme, which is included in the sequence data prior to the editing, and, each of the plurality of pieces of processing content information.

(8) In the voice synthesis device according to (1), the sequence data generation unit generates a plurality of pieces of sequence data. Each of the plurality of pieces of sequence data is obtained by editing the all or part of the plurality of kinds of parameters included in the sequence data, within a segment designated by the user.

(9) The voice synthesis device according to (8) further includes a display unit configured to display a plurality of segments as candidates for generating the plurality of pieces of sequence data.

(10) A voice synthesis method includes a step of generating sequence data including a plurality of kinds of parameters for controlling vocalization of a voice to be synthesized based on music information and lyrics information; a step of outputting a singing voice based on the sequence data; a step of acquiring a plurality of pieces of processing content information, associated with each of pieces of preset singing manner information. Each of the plurality of pieces of processing content information indicates contents of edit processing for all or part of the plurality of kinds of parameters. The voice synthesis method also includes a step of generating a plurality of pieces of sequence data. The plurality of pieces of sequence data are obtained by editing the all or part of the plurality of kinds of parameters included in the sequence data, based on the plurality of pieces of processing content information associated with one of the pieces of singing manner information specified by a user.

(11) The voice synthesis method according to (10) further includes outputting singing voices based on the plurality of pieces of sequence data in order.

(12) The voice synthesis method according to (10) further includes a step of generating a plurality of pieces of sequence data. Each of the plurality of pieces of sequence data is obtained by editing the all or part of the plurality of kinds of parameters included in the sequence data, based on a combination of all or part of the plurality of pieces of processing content information associated with the one of the pieces of singing manner information specified by the user.

(13) In the voice synthesis method according to (11), each of the plurality of pieces of processing content information is further associated with priority information indicating a priority of outputting the singing voice. The voice synthesis method further comprises outputting the singing voices based on the generated plurality of pieces of sequence data in order in accordance with the priority.

(14) In the voice synthesis method according to (13), the priority is updated based on an evaluation value for the edited sequence data input by the user.

(15) The voice synthesis method according to (10) further includes a step of outputting only the singing voice based on a generated piece of sequence data, which has a difference between the singing voice output based on the generated piece of sequence data and the singing voice output based on the sequence data prior to the editing, among the generated plurality of pieces of sequence data. The difference is equal to or larger than a predetermined threshold value.

(16) In the voice synthesis method according to (10), the step of generating a plurality of pieces of sequence data generates only part of the plurality of pieces of sequence data based on a phoneme, which is included in the sequence data prior to the editing, and, each of the plurality of pieces of processing content information.

(17) In the voice synthesis method according to (10), the step of generating a plurality of pieces of sequence data generates a plurality of pieces of sequence data. Each of the plurality of pieces of sequence data is obtained by editing the all or part of the plurality of kinds of parameters included in the sequence data, within a segment designated by the user.

(18) The voice synthesis method according to (17) further includes a step of displaying a plurality of segments as candidates for generating the plurality of pieces of sequence data.

(19) A non-transitory computer-readable recording medium storing a voice synthesis program, the voice synthesis program comprising instructions to: generate sequence data including a plurality of kinds of parameters for controlling vocalization of a voice to be synthesized based on music information and lyrics information; output a singing voice based on the sequence data; and acquire a plurality of pieces of processing content information, associated with each of pieces of preset singing manner information. Each of the plurality of pieces of processing content information indicates contents of edit processing for all or part of the plurality of kinds of parameters. The voice synthesis program also includes an instruction to generate a plurality of pieces of sequence data. The plurality of pieces of sequence data are obtained by editing the all or part of the plurality of kinds of parameters included in the sequence data, based on the plurality of pieces of processing content information associated with one of the pieces of singing manner information specified by a user.

BRIEF DESCRIPTION OF THE DRAWINGS

FIG. 4 is a diagram illustrating an example of a retake support table 144*c* stored in a nonvolatile storage unit 144 of the vocal synthesis device 10A.

FIG. 6A is a diagram illustrating examples of sequence data for vocal synthesis generated by the control unit 110.

FIG. 6B is a diagram illustrating examples of sequence data for vocal synthesis generated by the control unit 110. to this embodiment.

DETAILED DESCRIPTION OF THE INVENTION

Now, a description is made of embodiments of the present invention with reference to the accompanying drawings.

A: First Embodiment

Figure 1:
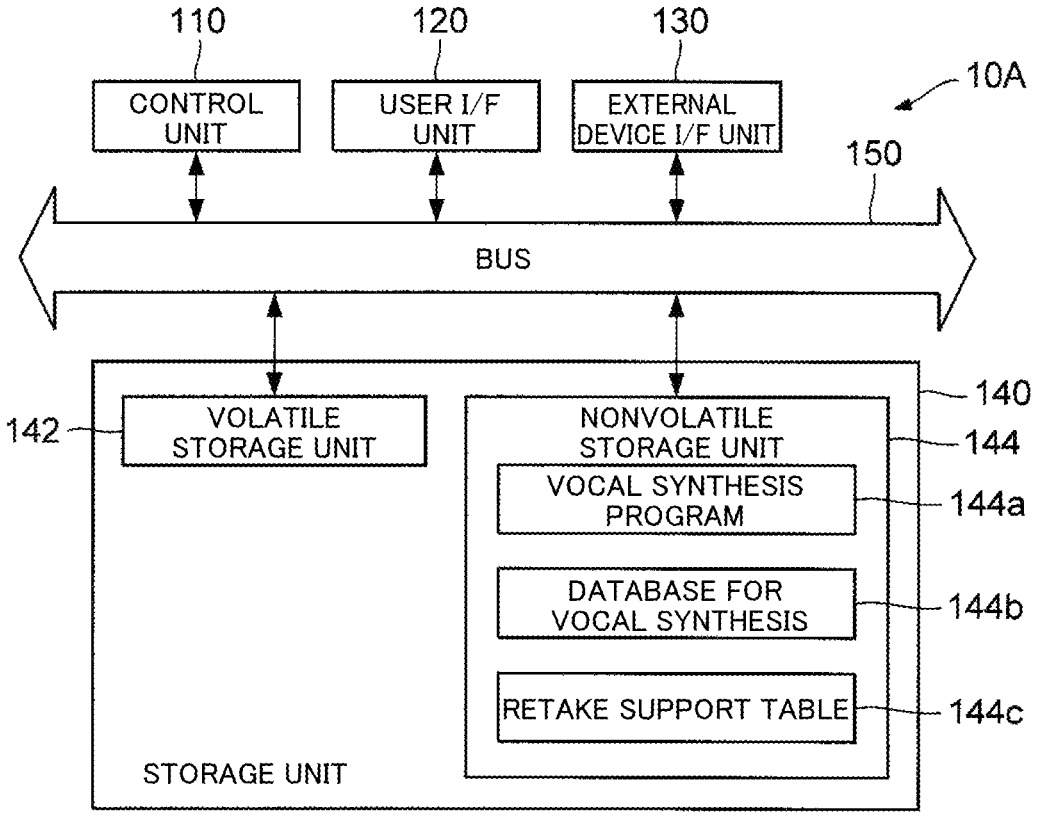
FIG. 1 is a diagram illustrating a configuration example of a vocal synthesis device 10A according to a first embodiment of the present invention.

FIG. 1 is a diagram illustrating a configuration example of a vocal synthesis device 10A according to a first embodiment of the present invention. The vocal synthesis device 10A is a device for, in the same manner as a related-art vocal synthesis device, electronically generating waveform data on a singing voice based on music information indicating a string of notes composing a melody of a song for which the singing voice is to be synthesized and lyrics information indicating lyrics to be sung in synchronization with the respective notes. As illustrated in FIG. 1, the vocal synthesis device 10A includes a control unit 110, a user I/F unit 120, an external device I/F unit 130, a storage unit 140, and a bus 150 for mediating data exchange among those components.

The control unit 110 is, for example, a central processing unit (CPU). The control unit 110 reads and executes a vocal synthesis program 144*a* stored in the storage unit 140 (more accurately, nonvolatile storage unit 144), to thereby function as a control center of the vocal synthesis device 10A. Processing executed by the control unit 110 in accordance with the vocal synthesis program 144*a* is described later.

The user I/F unit 120 provides various user interfaces for allowing a user to use the vocal synthesis device 10A. The user I/F unit 120 includes a display unit for displaying various screens and an operation unit for allowing the user to input various kinds of data and various instructions (both not shown in FIG. 1). The display unit is formed of a liquid crystal display and a drive circuit therefor, and displays various screens under control of the control unit 110. The operation unit includes a keyboard provided with a large number of operation keys such as a numeric keypad and a cursor key and a pointing device such as a mouse. When the user performs a given operation on the operation unit, the operation unit gives data indicating details of the given operation to the control unit 110 through the bus 150. With this operation, the details of the user's operation are transmitted to the control unit 110.

Figure 2:
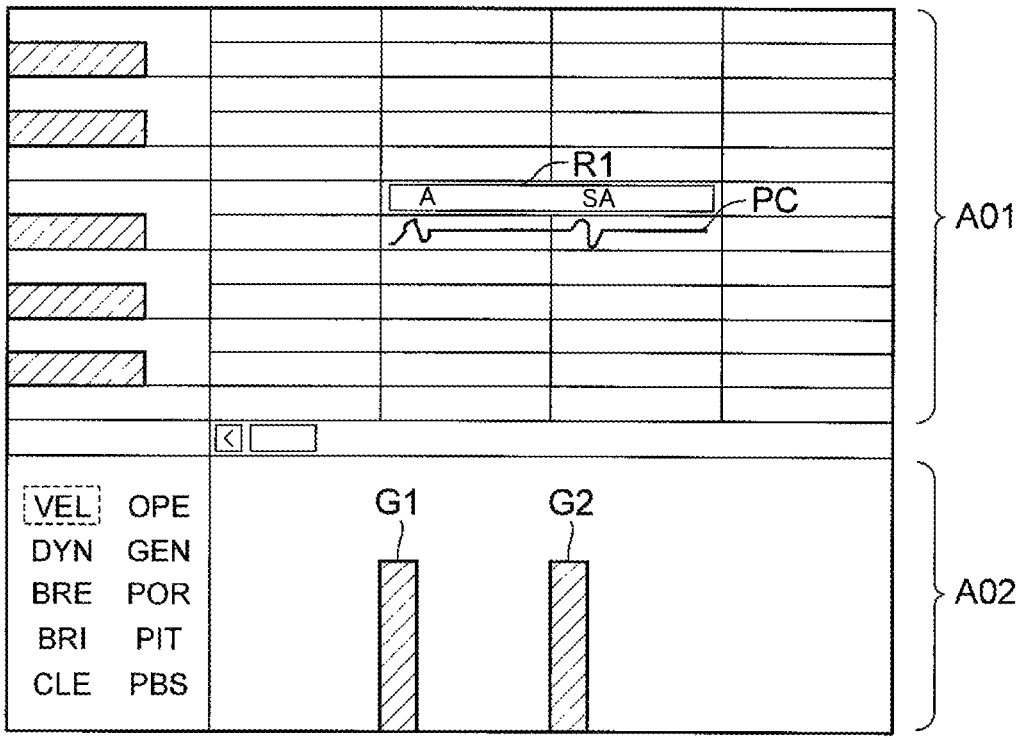
FIG. 2 is a diagram illustrating an example of an input screen displayed on a display unit of a user I/F unit 120 of the vocal synthesis device 10A.

Examples of the screens displayed on the display unit included in the user I/F unit 120 include an input screen for allowing the user to input the music information and the lyrics information and a retake support screen for supporting the user to retake a synthesized singing voice. FIG. 2 is a diagram illustrating an example of the input screen. As illustrated in FIG. 2, the input screen has two areas of an area A01 and an area A02. An image emulating a piano roll is displayed in the area A01. In the image, a vertical axial direction (direction in which keys of the piano roll are arrayed) represents a pitch, and a horizontal axial direction represents time. The user can input information relating to a note (pitch, sound generation start time, and duration of the note) by drawing a rectangle R1 in a position corresponding to a desired pitch and a sound generating time within the area A01 with the mouse or the like, and can input the lyrics information by inputting a hiragana and a phonetic symbol that represent a phoneme to be vocalized in synchronization with the note in the rectangle R1. Further, by drawing a pitch curve PC below the above-mentioned rectangle R1 with the mouse or the like, the user can designate a change over time of the pitch.

The area A02 is an area for allowing the user to designate: a value of a parameter other than the music information or the lyrics information, such as a velocity (represented as "VEL" in FIG. 2) or a volume (represented as "DYN" in FIG. 2), among parameters each of which indicates a vocalization manner of a voice and is used for controlling vocalization of the voice; and the change over time of the parameter. For example, FIG. 2 illustrates an exemplary case where the velocity is designated. The user can designate the value of a desired parameter and the change over time thereof by designating a character string corresponding to the parameter with the mouse or the like and drawing a graph (in the example of FIG. 2, graphs G1 and G2) indicating the value of the parameter.

Figure 3A:
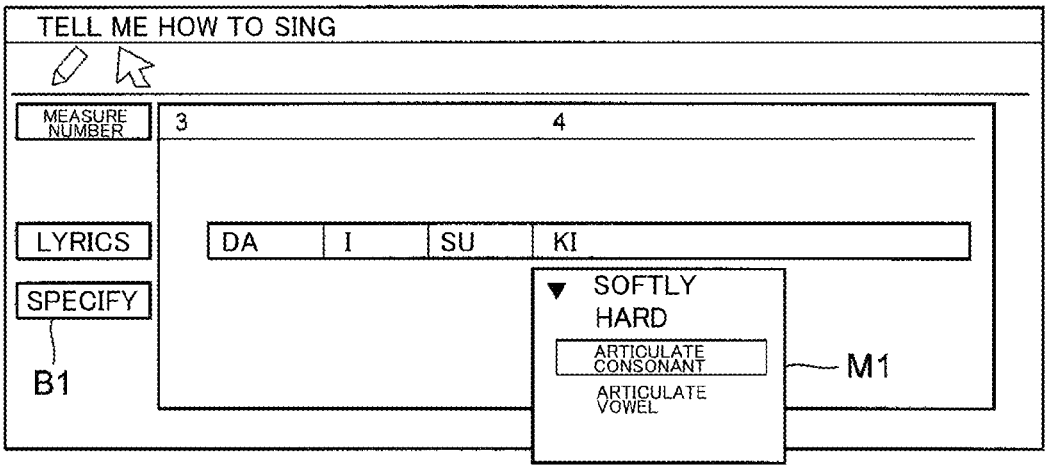
FIG. 3A is a diagram illustrating examples of a retake support screen displayed on the display unit of the user I/F unit 120 of the vocal synthesis device 10A.
Figure 3B:
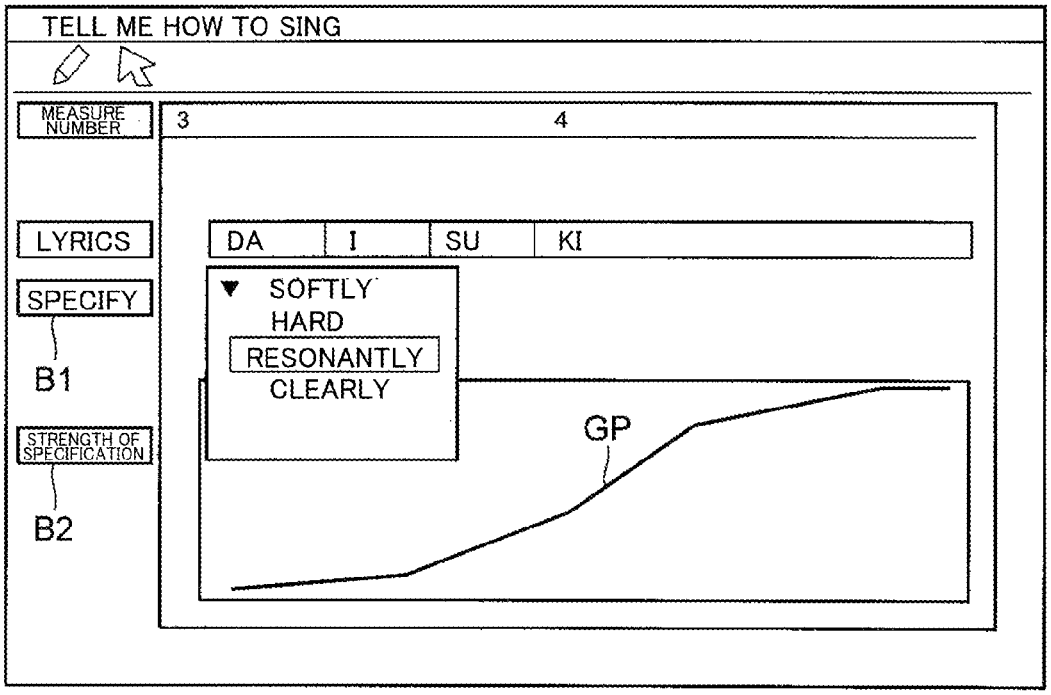
FIG. 3B is a diagram illustrating examples of a retake support screen displayed on the display unit of the user I/F unit 120 of the vocal synthesis device 10A.

When a time segment whose retake is desired is designated by dragging with the mouse or the like in the input screen illustrated in FIG. 2, the retake support screen illustrated in FIG. 3A is displayed on the display unit. FIG. 3A illustrates an exemplary case where the third measure and the fourth measure are designated as a retake segment. The user who has visually recognized the retake support screen can cause a singing manner designation menu M1 to be displayed by mouse-clicking on a "specify" button B1, and can select a desired singing manner from among a plurality of kinds of singing manners (in the example illustrated in FIG. 3A, four kinds of "softly", "hard", "articulate consonant", and "articulate vowel") displayed on the singing manner designation menu M1, to specify the singing manner. Note that, the specification of the singing manner is not limited to a note-by-note basis, and the singing manner may be specified over a plurality of notes. For example, as illustrated in FIG. 3B, when the singing manner "resonantly" is selected, a button B2 for designating strength of the specification is displayed, and the user may be allowed to input the strength of the specification by displaying a graph curve GP, which allows the user to designate the change over time of the strength of the specification, with the mouse-clicking of the button B2 as a trigger and allowing the graph curve GP to be deformed with the mouse or the like.

It should be understood that the synthesized singing voice can be retaken by directly editing various parameters through an operation on the above-mentioned input screen illustrated in FIG. 2. In particular, a user who is well versed in vocal synthesis can finely adjust the values of the various parameters to thereby realize a desired singing manner at will. However, most general users may not know how to edit which parameter to realize the desired singing manner. The vocal synthesis device 10A according to this embodiment has such a feature that even the general user who does not know how to edit which parameter to realize the desired singing manner can perform the retake with ease by designating the retake segment and further designating the singing manner on the retake support screen.

The external device I/F unit 130 is a set of various input/output interfaces such as a universal serial bus (USB) interface and a network interface card (NIC). In a case where an external device is connected to the vocal synthesis device 10A, the external device is connected to a preferred one of the various input/output interfaces included in the external device I/F unit 130. Examples of the external device connected to the external device I/F unit 130 include a sound system for reproducing sound in synchronization with the waveform data. Note that, in this embodiment, the lyrics information and the music information are input to the vocal synthesis device 10A through the user I/F unit 120, but may be input through the external device I/F unit 130. Specifically, a storage device such as a USB memory to which the music information and lyrics information on the song for which the singing voice is to be synthesized are written may be connected to the external device I/F unit 130, to cause the control unit 110 to execute processing for reading the information from the storage device.

The storage unit 140 includes a volatile storage unit 142 and the nonvolatile storage unit 144. The volatile storage unit 142 is formed of, for example, a random access memory (RAM). The volatile storage unit 142 is used by the control unit 110 as a work area used when various programs are executed. The nonvolatile storage unit 144 is formed of a nonvolatile memory such as a hard disk drive and a flash memory. The nonvolatile storage unit 144 stores programs and data for causing the control unit 110 to realize functions specific to the vocal synthesis device 10A according to this embodiment.

Examples of the programs stored in the nonvolatile storage unit 144 include the vocal synthesis program 144*a*. The vocal synthesis program 144*a* causes the control unit 110 to execute processing for generating the waveform data indicating the synthesized singing voice based on the music information and the lyrics information in the same manner as a program for a related-art vocal synthesis technology, and causes the control unit 110 to execute retake support processing specific to this embodiment. Examples of the data stored in the nonvolatile storage unit 144 include screen format data (not shown in FIG. 1) that defines formats of various screens, a database for vocal synthesis 144*b*, and a retake support table 144*c*. The database for vocal synthesis 144*b* is not particularly different from a database for vocal synthesis included in the related-art vocal synthesis device, and hence a detailed description thereof is omitted.

FIG. 4 is a diagram illustrating an example of the retake support table 144*c*.

As illustrated in FIG. 4, the retake support table 144*c* stores processing content data indicating a plurality of kinds of edit processing that can realize a given singing manner in association with a singing manner identifier (character string information representing each singing manner) indicating the given singing manner that can be designated on the retake support screen illustrated in FIG. 3A. In the example of FIG. 4, the processing content data indicating processing contents of three kinds of edit processing of "(method A): decrease velocity (in other words, increase duration of consonant)", "(method B): increase volume of consonant", and "(method C): decrease pitch of consonant" are stored in association with the singing manner identifier "articulate consonant".

As illustrated in FIG. 4, the plurality of kinds of edit processing are associated with one singing manner because which of the plurality of kinds of edit processing is most effective in realizing the one singing manner can be different depending on a context of the phoneme included in the retake segment and a type thereof. For example, when the consonant included in the lyrics within the retake segment is "s", the consonant "s" has no pitch, and hence it is conceivable that (method C) is ineffective while (method A) and (method B) are effective. Further, when the consonant included in the lyrics within the retake segment is "t", it is conceivable that (method B) is effective, and when the consonant included in the lyrics within the retake segment is "d", it is conceivable that any one of (method A), (method B), and (method C) is effective.

Figure 5:
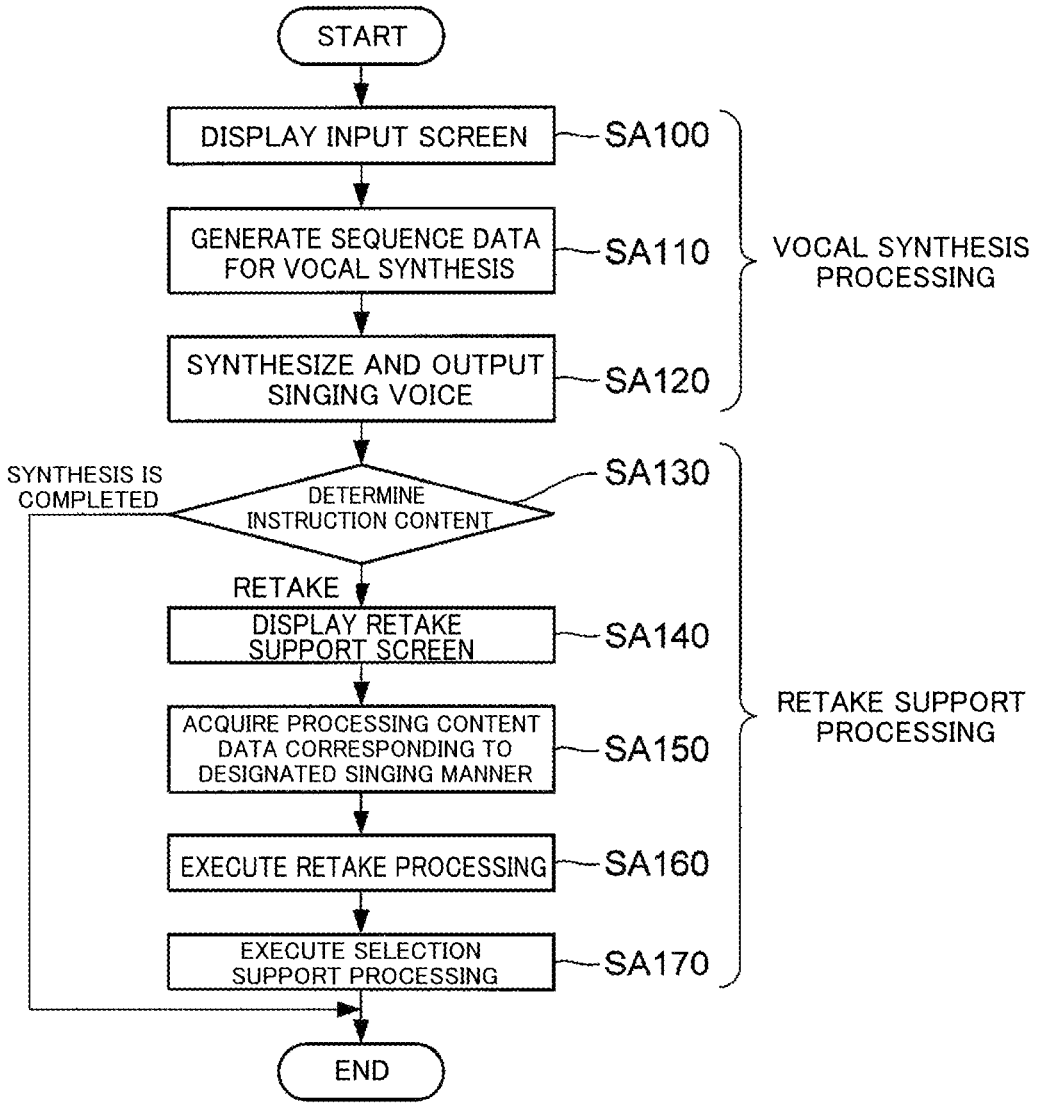
FIG. 5 is a flowchart illustrating a flow of processing executed by a control unit 110 in accordance with a vocal synthesis program 144*a* stored in the above-mentioned nonvolatile storage unit 144.

Next, a description is made of the processing executed by the control unit 110 in accordance with the vocal synthesis program 144*a*. The control unit 110 reads the vocal synthesis program 144*a* onto the volatile storage unit 142, and starts execution thereof. FIG. 5 is a flowchart illustrating a flow of the processing executed by the control unit 110 in accordance with the vocal synthesis program 144*a*. As illustrated in FIG. 5, the processing executed by the control unit 110 in accordance with the vocal synthesis program 144*a* is divided into vocal synthesis processing (Step SA100 to Step SA120) and the retake support processing (Step SA130 to Step SA170).

The control unit 110, which has started the execution of the vocal synthesis program 144*a*, first displays the input screen illustrated in FIG. 2 on the display unit of the user I/F unit 120 (Step SA100), and prompts the user to input the music information and the lyrics information. The user, who has visually recognized the input screen illustrated in FIG. 2, operates the operation unit of the user I/F unit 120 to input the music information and lyrics information on the song for which the synthesis of the singing voice is desired, to thereby instruct the control unit 110 to start the synthesis. When instructed to start the synthesis through the user I/F unit 120, the control unit 110 generates sequence data for vocal synthesis from the music information and the lyrics information that have been received through the user I/F unit 120 (Step SA110).

FIG. 6A is a diagram illustrating a score for vocal synthesis exemplifying the sequence data for vocal synthesis. As illustrated in FIG. 6A, the score for vocal synthesis includes a pitch data track and a phonemic data track. The pitch data track and the phonemic data track are pieces of time-series data that share a time axis. The various parameters indicating the pitch, the volume, and the like of each of the notes composing a piece of music are mapped in the pitch data track, and a phoneme string composing the lyrics to be pronounced in synchronization with the respective notes is mapped in the phonemic data track. That is, in the score for vocal synthesis illustrated in FIG. 6A, a common time axis is used as the time axis of the pitch data track and the time axis of the phonemic data track, to thereby associate the information relating to the notes composing the melody of the song for which the singing voice is to be synthesized with the phonemes of the lyrics to be sung in synchronization with the notes.

FIG. 6B is a diagram illustrating another specific example of the sequence data for vocal synthesis. The sequence data for vocal synthesis illustrated in FIG. 6B is XML-format data, in which, for each of the notes composing the piece of music, a pair of the information (such as sound generating time, duration of the note, pitch, volume, and velocity) relating to sound represented by the note and the information (phonogram and phoneme representing a part of the lyrics) relating to a part of the lyrics vocalized in synchronization with the note is described. For example, in the XML-format sequence data for vocal synthesis illustrated in FIG. 6B, data delimited by the tag <note> and the tag </note> corresponds to one note. To describe in more detail, within the data delimited by the tag <note> and the tag </note>, data delimited by the tag <posTick> and the tag </posTick> represents the vocalized time of the note, data delimited by the tag <durTick> and the tag </durTick> represents the duration of the note, and data delimited by the tag <noteNum> and the tag </noteNum> represents the pitch of the note. In addition, data delimited by the tag <Lyric> and the tag </Lyric> represents a part of the lyrics vocalized in synchronization with the note, and data delimited by the tag <phnms> and the tag </phnms> represents the phoneme corresponding to the part of the lyrics.

There are various modes conceivable as to what kind of units the sequence data for vocal synthesis is generated in. Examples thereof may include a mode for generating one piece of sequence data for vocal synthesis over the entire piece of music for which the singing voice is to be synthesized and a mode for generating the sequence data for vocal synthesis for each of blocks of the piece of music such as the first verse and the second verse or the A section, the B section, and the chorus. However, it should be understood that the latter mode is preferred in consideration of performing the retake.

In Step SA120 that follows Step SA110, the control unit 110 first generates the waveform data of the synthesized singing voice based on the sequence data for vocal synthesis generated in Step SA110. Note that, the generation of the waveform data on the synthesized singing voice is not particularly different from generation for the related-art vocal synthesis device, and hence a detailed description thereof is omitted. Subsequently, the control unit 110 gives the waveform data generated based on the sequence data for vocal synthesis to the sound system connected to the external device I/F unit 130, and outputs the waveform data as sound.

The above description is directed to the vocal synthesis processing.

Next, a description is made of the retake support processing.

The user can listen to the synthesized singing voice output from the sound system and verify whether or not the singing voice has been synthesized as intended. Then, the user can operate the operation unit of the user I/F unit 120 in order to issue an instruction to complete the synthesis or to perform the retake (specifically, information indicating the time segment that needs to be subjected to the retake). Specifically, the instruction to complete the synthesis is issued when the singing voice has been synthesized as intended, while the instruction to perform the retake is issued when the singing voice has not been synthesized as intended. The control unit 110 determines which of the instruction to complete the synthesis and the instruction to perform the retake is issued through the user I/F unit 120 (Step SA130). When the instruction to complete the synthesis has been issued, the control unit 110 writes the sequence data for vocal synthesis generated in Step SA110 (or waveform data generated in Step SA120) to a predetermined storage area of the nonvolatile storage unit 144, to finish executing the vocal synthesis program 144*a*. In contrast, when the instruction to perform the retake has been issued by the user, processing of Step SA140 and the subsequent steps is executed. Specifically, for example, the control unit 110 receives the information indicating the time segment that needs to be subjected to the retake, and executes the processing of Step SA140 and the subsequent steps.

In Step SA140 executed when the instruction to perform the retake has been issued, the control unit 110 displays the retake support screen illustrated in FIG. 3A on the display unit of the user I/F unit 120. The user, who has visually recognized the retake support screen, can operate the operation unit of the user I/F unit 120 to designate a desired singing manner from among a plurality of singing manners. The control unit 110, which has thus received the designation of the singing manner, first reads a plurality of pieces of processing content data stored in the retake support table 144*c* in association with the singing manner (Step SA150).

Subsequently, the control unit 110 executes the retake processing (Step SA160) for subjecting the sequence data for vocal synthesis, which belongs to a segment designated in Step SA140, to processing for editing the parameter based on the processing contents indicated by each of a plurality of kinds of processing content data read in Step SA150. Note that, in the retake processing, the edit processing is not only performed based on each of the plurality of kinds of processing content data read in Step SA150, but may also be executed by combining a plurality of kinds of edit processing.

For example, when the singing manner designated by the user is "articulate consonant", not only (method A), (method B), and (method C) illustrated in FIG. 4 but also a combination of (method A) and (method B), a combination of (method A) and (method C), a combination of (method B) and (method C), and a combination of (method A), (method B), and (method C) are each executed. This is because it is conceivable that the consonant can be articulated with effect by executing any one of (method A), (method B), and (method C) when a tempo of the synthesized singing voice to be retaken is slow, while it is conceivable that the sufficient effect cannot be produced without combining a plurality of methods when the tempo is fast or when the note included in the retake segment has a short note duration. In this case, the vocal synthesis device 10A may be configured so that, for example, the above-mentioned combination such as (method A), (method B), and (method C) and (method A) and (method B) is executed in order and presented to the user to allow the user to verify whether or not the singing voice has been synthesized as intended in order. Further, the vocal synthesis device 10A may be configured so that icons corresponding to each of the above-mentioned methods and each of the above-mentioned combinations are displayed, and each method or the like corresponding to the icon is executed each time the user selects the icon and presented to the user to allow the user to verify whether or not the singing voice has been synthesized as intended in order.

Further, a phrase structure and a music structure within the retake segment may be used for the retake processing. For example, when "more powerfully" is specified as the singing manner, measure-based options such as "emphasize entire retake segment", "emphasize only first beat", "emphasize only second beat", . . . , "emphasize only first beat by 10%", and "emphasize only first beat by 20%" may be presented to the user, and the processing contents of the retake processing may be caused to differ depending on the user's selection. Further, an accent part of a word included in the lyrics within the retake segment may be emphasized with reference to a dictionary storing information indicating an accent position for each word, and an option that allows the user to designate whether or not to emphasize such an accent part may be presented.

Further, in SA130, on the input screen of the display unit, one or a plurality of candidates for the retake segment whose delimiter position is set in advance may be displayed, and the user may be prompted to select a desired retake segment from among the candidates. In this case, for example, when there is the user's input of a breath symbol/note (such as [Sil] or [br]) to the sequence data for vocal synthesis, when there is a measure in which no note is input, or when there is a rest segment having a duration whose value is equal to or larger than a predetermined threshold value, the delimiter position of the retake segment is set based on part or all thereof. Then, the control unit 110 automatically designates the delimiter position based on how the above-mentioned information is input on the input screen, and displays one or a plurality of candidates for the retake segment on the input screen based on the delimiter position. The user may be allowed to operate the operation unit (such as pointing device) to adjust positions of a start point and an end point of the candidate for the retake segment on the input screen. In this case, it is possible to support the user based on the designation of the retake segment of the synthesized singing voice.

Figure 7A:
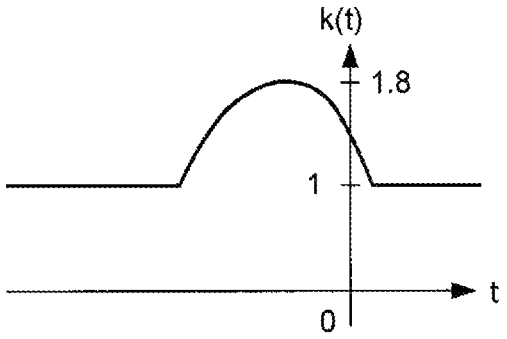
FIG. 7A is a graph showing examples of edit processing according to this embodiment.
Figure 7B:
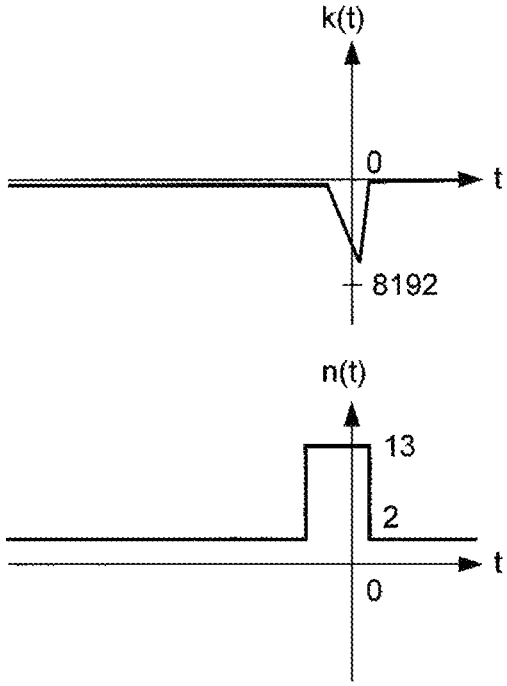
FIG. 7B is a graph showing examples of edit processing according to this embodiment.

In the editing performed by (method A) according to this embodiment, the control unit 110 calculates an edited velocity V1 by multiplying an unedited velocity V0 by 1/10. Further, in the editing performed by (method B), the control unit 110 calculates a parameter D1[t] indicating an edited volume by multiplying a parameter D0[t] indicating an unedited volume by a function k[t], which represents a curve that has a peak at a note-on time (in this operation example, t=0) and exhibits a constant value (in this embodiment, 1) in the other time segments as shown in FIG. 7A. This raises the volume only in the vicinity of the note-on time. Then, in the editing performed by (method C), the control unit 110 calculates a parameter P1[t] indicating the edited pitch by subtracting the function k[t], which represents a curve having a steep valley at the note-on time (in this operation example, t=0) as shown in FIG. 7B, from a parameter P0[t] indicating an unedited pitch, and further uses the value of a function n[t] shown in FIG. 7B as a parameter B1[t] indicating pitch bend sensibility.

When the above-mentioned retake processing is completed, the control unit 110 executes selection support processing (Step SA170). In the selection support processing, the control unit 110 presents the singing voices indicated by a plurality of pieces of sequence data for vocal synthesis generated in the retake processing to the user, and prompts the user to select any one of the sequence data for vocal synthesis. Note that, for example, when there is only one piece of sequence data for vocal synthesis generated in the retake processing, the control unit 110 may be configured to present only the singing voice indicated by the one piece of sequence data for vocal synthesis to the user and prompt the user to select the singing voice. The user previews the singing voices presented by the vocal synthesis device 10A, and selects one that seems to best realize the singing manner designated on the retake support screen, to thereby instruct the vocal synthesis device 10A to complete the retake. The control unit 110 saves the sequence data for vocal synthesis as instructed by the user, which completes the retake of the synthesized singing voice.

Figure 8A:
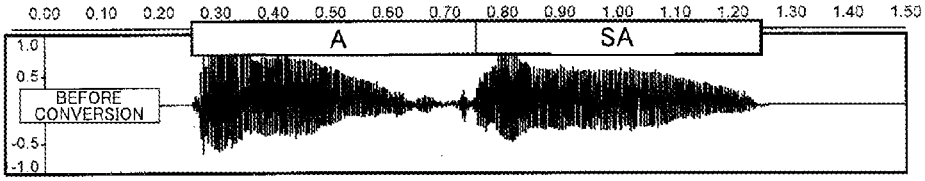
FIG. 8A is a diagram for illustrating effects of the above-mentioned edit processing.
Figure 8B:
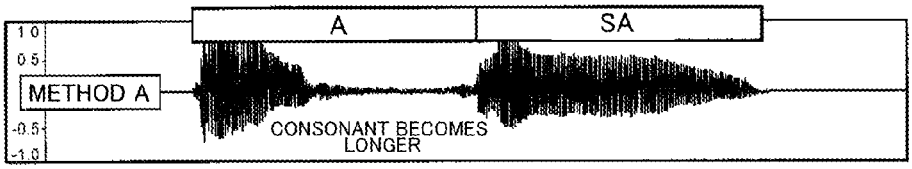
FIG. 8B is a diagram for illustrating effects of the above-mentioned edit processing.
Figure 8C:
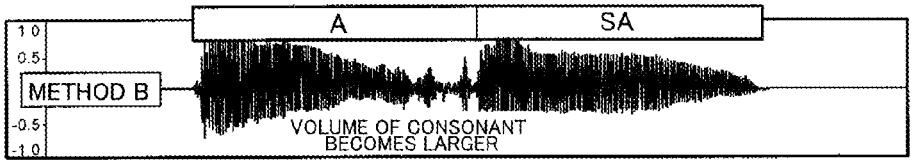
FIG. 8C is a diagram for illustrating effects of the above-mentioned edit processing.
Figure 8D:
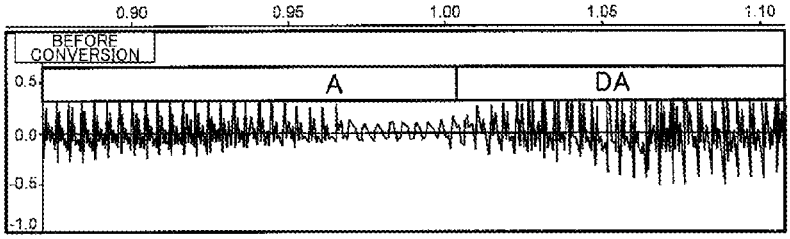
FIG. 8D is a diagram for illustrating effects of the above-mentioned edit processing.
Figure 8E:
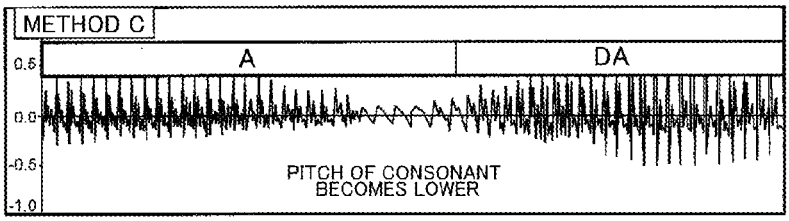
FIG. 8E is a diagram for illustrating effects of the above-mentioned edit processing.

For example, in a case where the part of the lyrics within the retake segment is "asa", such a sound waveform before the retake as illustrated in FIG. 8A is subjected to the editing performed by (method A) to obtain the edited sound waveform illustrated in FIG. 8B, and is further subjected to the editing performed by (method B) to obtain the edited sound waveform illustrated in FIG. 8C. Further, in a case where the part of the lyrics within the retake segment is "ada", such a sound waveform before the retake as illustrated in FIG. 8D is subjected to the editing performed by (method C) to obtain the edited sound waveform illustrated in FIG. 8E. A difference between the sound waveform illustrated in FIG. 8A and the sound waveform illustrated in FIG. 8B (or FIG. 8C) or a difference between the sound waveform illustrated in FIG. 8D and the sound waveform illustrated in FIG. 8E is perceived by the user as such a difference in audibility as whether or not the consonant is heard clearly.

As described above, according to this embodiment, without directly editing the parameter such as the pitch, the velocity, or the volume, it is possible to realize the retake of the synthesized singing voice in the desired singing manner. Note that, this embodiment has been described by taking the case where each piece of processing content data acquired in Step SA150 is used to edit the sequence data for vocal synthesis, and the sequence data for vocal synthesis corresponding to the each piece of processing content data is generated, after which the selection support processing is executed, but the retake processing and presentation of a retake result may be repeated by the number of pieces of processing content data. Specifically, it should be understood that (1)"edit of the sequence data for vocal synthesis" (2) "generation of the waveform data based on the edited sequence data for vocal synthesis" (3) "output of the waveform data as sound (in other words, presentation of an edit result)" may be repeated by the number of pieces of processing content data.

Further, when a screen size that can display the singing manner designation menu M1 is small compared with the kinds of singing manners that can be designated, those singing manners may be grouped (for example, into a group relating to the singing manner on a note-by-note basis and a group relating to the singing manner over the plurality of notes), and the processing of Step SA140 to Step SA170 may be repeated by the number of groups in such an order as (1) "designation of the singing manner on a note-by-note basis" (2) "edit of the sequence data for vocal synthesis" (3) "generation of the waveform data based on the edited sequence data for vocal synthesis" (4) "output of the waveform data as sound" (5) "designation of the singing manner over the plurality of notes" (6) "edit of the sequence data for vocal synthesis"→ . . . (alternatively, with the completion of the processing of Step SA140 to Step SA170 for one group as a trigger, the processing of Step SA130 is executed to prompt the user to input an instruction to complete the synthesis or perform the retake, and the processing for another group is started when the instruction to perform the retake is issued (in other words, when the instruction to execute the retake again is issued), while the processing for another group is omitted when the instruction to complete the synthesis is issued). Note that, when the instruction to execute the retake again is issued, the retake segment may be designated again, or the designation of the retake segment may be omitted (in other words, the same retake segment as that of the group immediately before may be set). According to such a mode, it is not only possible to handle such a situation that the singing manner designation menu M1 cannot be displayed in a sufficient screen size, but also possible to effectively prevent the user from getting confused when various singing manners are presented at a time.

Further, in a mode for grouping the singing manners into the group on the note-by-note basis, the group over the plurality of notes, a group over a plurality of measures, . . . , the singing manners are presented to the user in order from the group of the singing manners on the note-by-note basis, to thereby allow the retake results to be verified systematically from the group on the note-by-note basis to a group for a wider edit range, which enables even a beginner user who is unfamiliar with vocal synthesis to perform the retake of the singing voice easily and systematically. Note that, in a case where only one kind of singing manner belongs to one group as a result of grouping the singing manner, which is naturally acceptable, when the singing manner designation menu M1 for the one group is displayed, the singing manner designation menu M1 merely labeled "retake" may be displayed in place of the singing manner identifier (for example, "articulate consonant") indicating the one kind of singing manner. This is because there is a fear that the presentation of detailed information may cause the beginner user to feel confused or uneasy, and simple display may be preferred in some cases.

B: Second Embodiment

Figure 9:
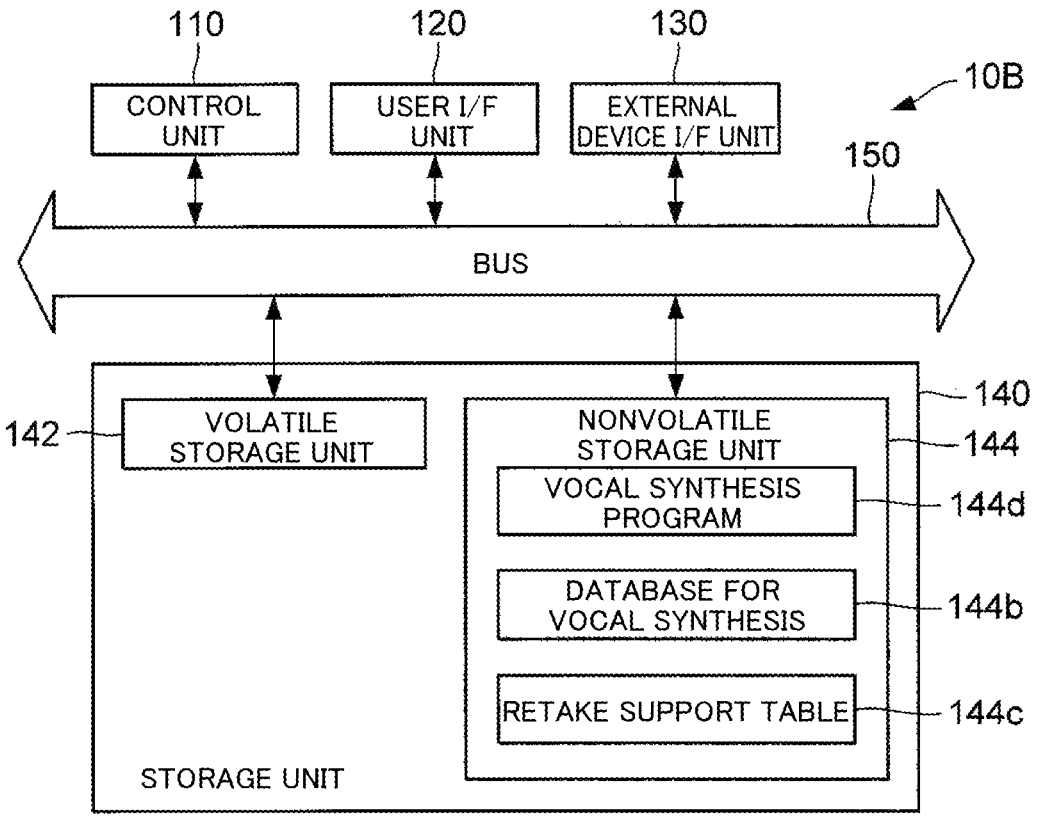
FIG. 9 is a diagram illustrating a configuration example of a vocal synthesis device 10B according to a second embodiment of the present invention.

FIG. 9 is a diagram illustrating a configuration example of a vocal synthesis device 10B according to a second embodiment of the present invention.

In FIG. 9, the same components as those of FIG. 1 are denoted by the same reference symbols. As apparent from comparison between FIG. 9 and FIG. 1, the configuration of the vocal synthesis device 10B is different from the configuration of the vocal synthesis device 10A in that a vocal synthesis program 144*d* is stored in the nonvolatile storage unit 144 instead of the vocal synthesis program 144*a*. The vocal synthesis program 144*d*, which is the difference from the first embodiment, is mainly described below.

Figure 10:
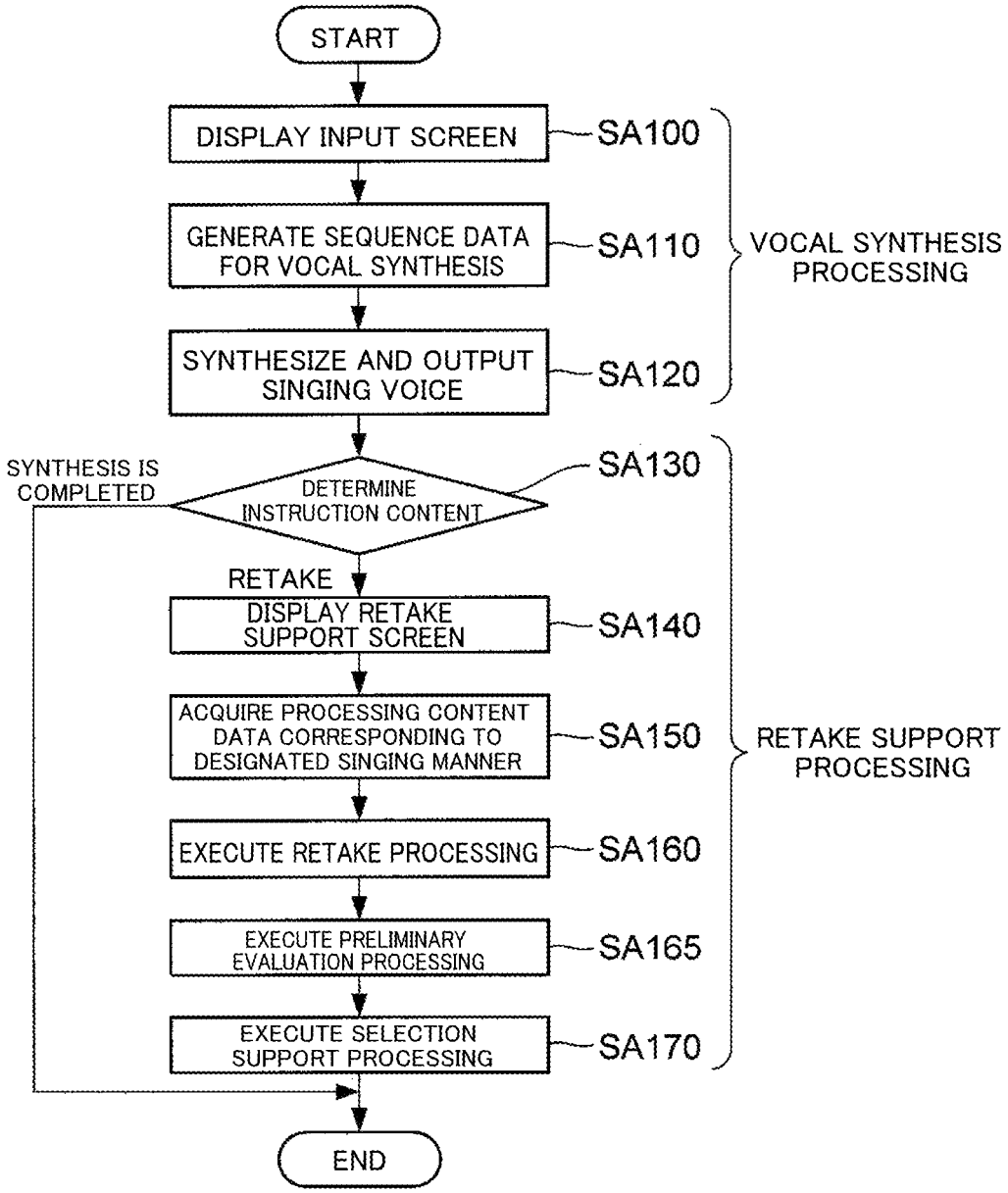
FIG. 10 is a flowchart illustrating a flow of processing executed by the control unit 110 of the vocal synthesis device 10B in accordance with a vocal synthesis program 144*d*.

FIG. 10 is a flowchart illustrating a flow of processing executed by the control unit 110 in accordance with the vocal synthesis program 144*d*. As apparent from comparison between FIG. 10 and FIG. 5, the vocal synthesis program 144*d* according to this embodiment is different from the vocal synthesis program 144*a* according to the first embodiment in that the vocal synthesis program 144*d* causes the control unit 110 to execute preliminary evaluation processing (Step SA165) following the retake processing (Step SA160), and to execute the selection support processing (Step SA170) after the execution of the preliminary evaluation processing. The preliminary evaluation processing (Step SA165), which is the difference from the first embodiment, is mainly described below.

In the preliminary evaluation processing (Step SA165), the control unit 110 generates the waveform data based on each piece of sequence data for vocal synthesis generated in the retake processing, determines whether or not there is a difference between the waveform data generated based on an original piece of sequence data for vocal synthesis and each piece of sequence data for vocal synthesis generated in the retake processing, and excludes the singing voice indicated by the piece of sequence data for vocal synthesis, which has been determined to have no difference, from the singing voices to be presented to the user in the selection support processing (Step SA170). Here, as a specific method of determining whether or not there is a difference between the waveform data generated based on the piece of sequence data for vocal synthesis generated in the retake processing and the waveform data generated based on the original piece of sequence data for vocal synthesis, there may be a mode for obtaining a difference (for example, difference in amplitude) between samples at the same time within a sample string representing the waveform data on the former piece and a sample string representing the waveform data on the latter piece, and determining that "there is a difference" when a total sum of the absolute value of the difference exceeds a predetermined threshold value, and a mode for obtaining a correlation coefficient between the two sample strings, and performing the determination based on how far the value of the correlation coefficient falls below one. The above-mentioned preliminary evaluation processing is provided for the following reason.

The edit processing indicated by each of the plurality of kinds of processing content data associated with the singing manner identifier can realize the singing manner indicated by the singing manner identifier, but as described above, a sufficient effect may not be obtained depending on what kind of phoneme is included in the retake segment or depending on the tempo or the note duration. The fact that there is no difference between the waveform data generated based on the piece of sequence data for vocal synthesis generated by being subjected to the edit indicated by the processing content data and the waveform data generated based on the original piece of sequence data for vocal synthesis means that edit contents indicated by the processing content data do not exhibit a sufficient effect to realize the singing manner. That is, the preliminary evaluation processing according to this embodiment is provided in order to exclude the retake result, which cannot fully realize the singing manner designated by the user, from the retake result to be verified by the user and to allow the user to efficiently perform verification work.

According to this embodiment as well as the first embodiment, without directly editing the parameter such as the pitch, the velocity, or the volume, it is possible to realize the retake of the synthesized singing voice in the desired singing manner. In addition, according to this embodiment, it is possible to exclude the retake result exhibiting no effect from the retake result to be presented to the user and to allow the user to efficiently perform the verification and selection of the retake result.

C: Modifications

The first and second embodiments of the present invention have been described above, but the following modifications may naturally be added to those embodiments. (1) Each of the above-mentioned embodiments is described by taking the example of applying the present invention to the vocal synthesis device for electronically synthesizing the singing voice based on the music information and the lyrics information. However, the application of the present invention is not limited to the vocal synthesis device, but may naturally be applied to a voice synthesis device for electronically synthesizing a narrating voice for a literary work or a guidance voice based on information indicating a change in rhythm of a voice to be synthesized (information corresponding to the music information for the vocal synthesis) and information indicating the phoneme string of the voice (information corresponding to the lyrics information for the vocal synthesis). Further, instead of a device dedicated to voice synthesis, the present invention may naturally be applied to, for example, a device for executing voice synthesis processing in parallel with other processing (or as part of other processing) such as a game machine for executing a role-playing game or the like that outputs a character's line as sound or a toy having an audio playback function.

(2) In each of the above-mentioned embodiments, the retake support table 144*c* is stored in the nonvolatile storage unit 144 as data separate from the vocal synthesis program. However, the retake support table 144*c* may be stored in the nonvolatile storage unit 144 integrally with the vocal synthesis program (in other words, by incorporating the retake support table 144*c* into the vocal synthesis program).

(3) In each of the above-mentioned embodiments, the processing content data indicating mutually different kinds of edit processing is stored in the retake support table 144*c* in association with the singing manner identifier indicating the singing manner. However, a plurality of pieces of processing content data indicating the same edit contents while exhibiting mutually different editing strengths may be stored in the retake support table 144*c* as pieces of processing content data indicating mutually different edit contents. For example, the plurality of pieces of processing content data are stored in the retake support table 144*c* illustrated in FIG. 4 in place of the above-mentioned processing content data indicating (method A) so that the processing content data indicating that the velocity is to be multiplied by ½ is stored as the processing content data indicating (method A1), the processing content data indicating that the velocity is to be multiplied by ⅓ is stored as the processing content data indicating (method A2), and the processing content data indicating that the velocity is to be multiplied by 1/10 is stored as the processing content data indicating (method A3). In this case, a combination of (method A1) and (method A2) may be handled as the edit processing for multiplying the velocity by ⅙, or the plurality of pieces of processing content data indicating the same edit contents while exhibiting mutually different editing strengths may be inhibited from being combined with one another.

(4) In each of the above-mentioned embodiments, the processing content data indicating a plurality of kinds of edit processing that can realize a given singing manner is stored in the retake support table 144*c* in association with the singing manner identifier indicating the given singing manner that can be designated on the retake support screen. However, only pieces of processing content data indicating mutually different processing contents may be stored in the retake support table 144*c*, the edit processing based on each of those pieces of processing content data may be performed for the sequence data for vocal synthesis, and the user may be allowed to verify the edit results and to select a desired retake result, or the user may be allowed to verify what kind of effect is produced by the edit processing and to classify the processing content data by effect. Note that, such verification/classification work may be automatically processed by using an existing singing scoring technology or an existing singing evaluation technology.

(5) With a priority given to each of a plurality of kinds of edit processing that realize the same singing manner in accordance with the user's preference, the retake results may be presented to the user in descending order of the priority given to the edit processing producing the retake result. Specifically, pieces of priority data (all of which are the same values in an initial state such as factory default) indicating priorities of the kinds of edit processing indicated by pieces of processing content data are stored in the retake support table 144*c* in association with the pieces of processing content data, the user is allowed to input an evaluation value (for example, zero when there seems no effect in the selection support processing, and a larger value for an effect that seems greater) for the retake result, and the control unit 110 is caused to execute evaluation processing for updating the priority of each of the pieces of processing content data based on the evaluation value. Then, in the selection support processing, the retake results are presented to the user in descending order of the priority given to the processing content data indicating the processing contents generating the retake result. According to such a mode, it is possible to reflect the user's preference on which piece of edit processing is used to realize a given singing manner, and to present the retake results in accordance with the user's preference. Further, with the pieces of priority data stored for the respective phonemes included in the retake segment, the edit processing may be selected based on the singing manner designated by the user and the phonemes included in the retake segment.

Further, the retake processing, the presentation of the retake result, and the input of evaluation (processing for prompting the user to input any one of the instruction to complete the synthesis and the instruction to perform the retake) may be performed for each piece of processing content data in descending order of the priority given thereto, and the priority may be updated each time the retake is instructed. According to such a mode, the order of employing the edit processing may be dynamically changed, and it is expected that the effect of allowing the user to verify and select the retake result with efficiency can be further strengthened. Note that, the vocal synthesis program according to the above-mentioned embodiments of the present invention can be used also for post-processing of an automatic music composing program.

(6) Each of the above-mentioned embodiments has been described by taking the example in which the input of the music information and the lyrics information and the designation of the retake segment and the singing manner are performed through the user I/F unit 120 provided to the vocal synthesis device. However, by providing a communication I/F section for transmitting/receiving data to/from a communication counterpart through a telecommunication line such as the Internet in place of the user I/F unit 120, the music information and the lyrics information may be input through the above-mentioned telecommunication line, and the retake segment and the singing manner may be designated therethrough, while each piece of sequence data for vocal synthesis generated in the retake processing (or waveform data generated based on the each piece of sequence data for vocal synthesis) may be returned through the above-mentioned telecommunication line. According to such a mode, the vocal synthesis can be provided as a so-called cloud service.

(7) In each of the above-mentioned embodiments, the program for causing the control unit 110 to execute the processing that remarkably exhibits the features of one or more embodiments of the present invention (vocal synthesis program 144*a* in the first embodiment or vocal synthesis program 144*d* in the second embodiment) is stored in advance in the nonvolatile storage unit of the vocal synthesis device. However, the above-mentioned program may be distributed by being recorded on a computer-readable recording medium such as a CD-ROM, or may be distributed by being downloaded through the telecommunication line such as the Internet. This is because a general computer can be caused to function as the vocal synthesis device according to each of the above-mentioned embodiments in accordance with the program distributed in such a manner.

Further, in each of the above-mentioned embodiments, the processing that remarkably exhibits one or more embodiments of features of the present invention (retake processing and selection support processing in the first embodiment or preliminary evaluation processing in addition to those two kinds of processing in the second embodiment) is realized by software. However, a retake unit for executing the retake processing may be formed of an electronic circuit, a selection support unit for executing the selection support processing may be formed of an electronic circuit, and those electronic circuits may be incorporated into a general vocal synthesis device to form the vocal synthesis device 10A according to the above-mentioned first embodiment, or in addition, an electronic circuit for executing the preliminary evaluation processing may be incorporated as a preliminary evaluation unit to form the vocal synthesis device 10B according to the above-mentioned second embodiment.

While the invention has been described with respect to a limited number of embodiments, those skilled in the art, having benefit of this disclosure, will appreciate that other embodiments can be advised which do not depart from the scope of the invention as described therein. Accordingly, the scope of the invention should be limited only by the attached claims.

For example, in one aspect of the present invention, there is provided a voice synthesis device for synthesizing a voice based on sequence data including a plurality of kinds of parameters indicating a vocalization manner of the voice, the voice synthesis device including: a retake unit configured to allow a user to designate a retake segment in which the voice is to be synthesized again, configured to edit the parameter within the retake segment among the parameters included in the sequence data by predetermined edit processing, and configured to generate the sequence data indicating a retake result; and a selection support unit configured to present sound indicated by the sequence data generated by the retake unit and allow the user to select one of re-execution of the retake and completion of the retake.

According to such a voice synthesis device, when the retake segment in which the voice is to be synthesized again is designated by the retake unit, the parameter included in the sequence data within the retake segment is edited by the predetermined edit processing, and the sound indicated by the edited sequence data is presented to the user. The user can instruct to complete the retake when a synthesized voice presented in such a manner is a voice synthesized in the user's desired vocalization manner, and when not, can instruct to execute the retake again, which allows the user to retake the synthesized voice without directly editing the various parameters. Note that, the number of kinds of edit processing that are provided may be only one or may be at least two. When a plurality of kinds of edit processing are predetermined, the selection support unit may present the edit result of each of the plurality of kinds of edit processing to the user, and allows the user to select the result obtained in the desired vocalization manner (in other words, to instruct to complete the retake). In this case, when the user does not select any one of the edit results, on the assumption that the user has instructed to execute the retake again, the retake unit may perform the processing again by, for example, adjusting the strength of the edit processing.

As a specific example of such a voice synthesis device, there may be provided a vocal synthesis device for synthesizing a singing voice based on the music information and the lyrics information. Further, other specific examples of the above-mentioned voice synthesis device include a voice synthesis device for electronically synthesizing a voice other than the singing voice, such as a narrating voice for a literary work or a guidance voice for various kinds of guidance, based on information indicating a change in rhythm of a voice to be synthesized and information indicating a substance to be vocalized. Further, as another aspect of the present invention, there may be provided a program for causing a computer to function as: a voice synthesis unit for synthesizing a voice based on sequence data including a plurality of kinds of parameters indicating a vocalization manner of the voice; a retake unit for allowing a user to designate a retake segment in which the voice is to be synthesized again, editing the parameter within the retake segment among the parameters included in the sequence data by predetermined edit processing, and generating the sequence data indicating a retake result; and a selection support unit for presenting sound indicated by each piece of sequence data generated by the retake unit and allowing the user to select one of re-execution of the retake and completion of the retake.

In another aspect of the present invention, as the edit processing, a plurality of kinds of edit processing are grouped by the vocalization manner (in case of vocal synthesis, singing manner such as "softly" or "articulate consonant") of the voice to be realized by performing the edit processing therefor, and the retake unit allows the user to designate the retake segment and the vocalization manner of the voice within the retake segment, and generates the sequence data indicating the retake results of the edit processing corresponding to the vocalization manner of the voice designated by the user. According to such an aspect, the user can retake the synthesized singing voice without directly editing the various parameters only by designating a desired vocalization manner and a desired retake segment to instruct to perform the retake.

In another aspect of the present invention, the voice synthesis device may further include a preliminary evaluation unit configured to exclude the voice having a small difference between the voices synthesized based on the sequence data subjected to the editing performed by the edit processing and the voice synthesized based on the unedited sequence data from the voices to be presented by the selection support unit. Some kinds of the above-mentioned edit processing exhibit dependency on phonemes, and produce substantially no effect on a specific phoneme. According to this aspect, the edit result producing substantially no effect due to the dependency on phonemes or the like can be excluded from the voices to be presented to the user.

In another aspect of the present invention, the voice synthesis device may further include: a table in which processing content data indicating processing contents of the edit processing and priority data indicating a priority of using the edit processing are stored in association with each other; and an evaluation unit configured to allow the user to input an evaluation value for sound represented by the sequence data for each piece of sequence data generated by the retake unit, and update, based on the evaluation value, the priority data associated with the processing content data indicating the processing contents of the edit processing used for generating the each piece of sequence data, and the selection support unit may present the sounds represented by the pieces of sequence data generated by the retake unit in descending order of the priority. Even the edit processing for realizing the same vocalization manner may often produce the edit result whose evaluation differs depending on the user's preference. According to such an aspect, it is possible to reflect the user's preference on which piece of edit processing is used to realize a given vocalization manner, and to present the retake results in order based on the user's preference.

What is claimed is:

1. A voice synthesis device, comprising:

a processor for executing a program, stored in storage, to cause the processor to be configured, the processor configured to:

generate sequence data SeqDi including a plurality Pkp of kinds of parameters for controlling vocalization of a voice to be synthesized based on music information and lyrics information;

a sound system configured to output a singing voice SVi based on the sequence data SeqDi;

wherein the processor is configured to:

acquire a plurality Ppci of pieces of processing content information in response to single piece SMI1 of singing manner information specified by a user, the plurality Ppci associated with the single piece SMI1 among a plurality Ppsmi of pieces of preset singing manner information, wherein each piece PCIx of the plurality Ppci of pieces of processing content information indicates respective contents Cepx of edit processing for all or part of the plurality Pkp of kinds of parameters, generate a plurality Ppsd of pieces of sequence data based on the acquired plurality Ppci of pieces of processing content information, wherein each piece SeqDpx of the plurality Ppsd of pieces of sequence data is generated by editing, based on a respective piece PCIx, all or part of the plurality Pkp of kinds of parameters included in the sequence data SeqDi according to respective contents Cepx, such that the plurality Ppsd of pieces of sequence data are generated based on the plurality Ppci of pieces of processing content information acquired in response to the single piece SMI of singing manner information, which is specified by the user, among the plurality Ppsmi of pieces of preset singing manner information.

2. The voice synthesis device according to claim 1, wherein the sound system is configured to output singing voices based on the plurality Ppsd of pieces of sequence data in order.

3. The voice synthesis device according to claim 2, wherein each of the plurality Ppci of pieces of processing content information is further associated with respective priority information indicating a respective priority of outputting a respective singing voice by the sound system, and wherein the sound system is configured to output the singing voices based on the generated plurality Ppsd of pieces of sequence data in order in accordance with the respective priorities.

4. The voice synthesis device according to claim 3, wherein the processor is configured to update one or more of the priorities based on an evaluation value for one of the generated plurality Ppsd of pieces of sequence data, the evaluation value input by the user.

5. The voice synthesis device according to claim 1, wherein each piece SeqDpx of the plurality Ppsd of pieces of sequence data is generated by editing, based on a respective combination CBx of all or part of the plurality Ppci of pieces of processing content information, all or part of the plurality Pkp of kinds of parameters included in the sequence data SeqDi, the respective combination CBx including respective piece PCIx of processing content information, wherein all the pieces of processing content information in the respective combination CBx are associated with the single piece SMI of singing manner information specified by the user.

6. The voice synthesis device according to claim 1, wherein, among the generated plurality Ppsd of pieces of sequence data, each generated piece SeqDpx of sequence data includes edited parameters, where each singing voice SVx, based on a respective generated piece SeqDpx of sequence data, has a respective difference Diffx from the singing voice SVi based on the sequence data SeqDi, and wherein the sound system is configured to output, for each generated piece SeqDpx of sequence data, the respective singing voice SVx only when its respective difference Diffx is equal to or larger than a predetermined threshold value.

7. The voice synthesis device according to claim 1, wherein only a part Teff of the plurality Ppci of pieces of processing information produces a substantial effect for a certain phoneme, wherein the processor is configured to generate, when the certain phoneme is included in the sequence data SeqDi, one or more of the plurality Ppsd of pieces of sequence data based on the part Teff of the plurality Ppci of pieces of processing information.

8. The voice synthesis device according to claim 1, wherein each of the plurality Ppsd of pieces of sequence data is generated by editing, within a segment designated by the user, all or part of the plurality Pkp of kinds of parameters included in the sequence data SeqDi.

9. The voice synthesis device according to claim 8, further comprising a display configured to display a plurality of segments as candidates for generating the plurality Ppsd of pieces of sequence data.

10. A voice synthesis method, comprising:

generating sequence data SeqDi including a plurality Pkp of kinds of parameters for controlling vocalization of a voice to be synthesized based on music information and lyrics information;

outputting a singing voice SVi based on the sequence data SeqDi;

acquiring a plurality Ppci of pieces of processing content information in response to a single piece SMI1 of singing manner information specified by a user, the plurality Ppci associated with the single piece SMI1 among a plurality Ppsmi of pieces of preset singing manner information, and wherein each piece PCIx of the plurality Ppci of pieces of processing content information indicates respective contents Cepx of edit processing for all or part of the plurality Pkp of kinds of parameters;

generating a plurality Ppsd of pieces of sequence data based on the acquired plurality Ppci of pieces of processing content information, wherein each piece SeqDpx of the plurality Ppsd of pieces of sequence data is generated by editing, based on a respective piece PCIx, all or part of the plurality Pkp of kinds of parameters included in the sequence data SeqDi according to respective contents Cepx, such that the plurality Ppsd of pieces of sequence data are generated based on the plurality Ppci of pieces of processing content information acquired in response to the single piece SMI of singing manner information, which is specified by the user, among the plurality Ppsmi of pieces of preset singing manner information.

11. The voice synthesis method according to claim 10, further comprises outputting singing voices based on the plurality Ppsd of pieces of sequence data in order.

12. The voice synthesis method according to claim 11, wherein each of the plurality Ppci of pieces of processing content information is further associated with respective priority information indicating a priority of outputting a respective singing voice, and wherein the voice synthesis method further comprises outputting the singing voices based on the generated plurality Ppsd of pieces of sequence data in order in accordance with the respective priorities.

13. The voice synthesis method according to claim 12, wherein the voice synthesis method further comprises updating one or more of the priorities based on an evaluation value for one of the generated plurality Ppsd of pieces of sequence data, the evaluation value input by the user.

14. The voice synthesis method according to claim 10, wherein each piece SeqDpx of the plurality Ppsd of pieces of sequence data is generated by editing, based on a respective combination CBx of all or part of the plurality Ppci of pieces of processing content information, all or part of the plurality Pkp of kinds of parameters included in the sequence data SeqDi, the respective combination CBx including respective piece PCIx of processing content information, wherein all the pieces of processing content information in the respective combination CBx are associated with the single piece SMI of singing manner information specified by the user.

15. The voice synthesis method according to claim 10, wherein, among the generated plurality Ppsd of pieces of sequence data, each generated piece SeqDpx of sequence data includes edited parameters, where each singing voice SVx, based on a respective generated piece SeqDpx of sequence data, has a respective difference Diffx from the singing voice SVi based on the sequence data SeqDi prior to the editing, among the generated plurality of pieces of sequence data, and wherein the voice synthesis method further comprises outputting, for each generated piece SeqDpx of sequence data, the respective singing voice SVx only when its respective difference Diffx is equal to or larger than a predetermined threshold value.

16. The voice synthesis method according to claim 10, wherein only a part Teff of the plurality Ppci of pieces of processing information produces a substantial effect for a certain phoneme, wherein, when the certain phoneme is included in the sequence data SeqDi, the generating a plurality Ppsd of pieces of sequence data generates one or more of the plurality Ppsd of pieces of sequence data based on the part Teff of the plurality Ppci of pieces of processing information.

17. The voice synthesis method according to claim 10, wherein each of the plurality Ppsd of pieces of sequence data is generated by editing, within a segment designated by the user, all or part of the plurality Pkp of kinds of parameters included in the sequence data SeqDi.

18. The voice synthesis method according to claim 17, further comprising displaying a plurality of segments as candidates for generating the plurality Ppsd of pieces of sequence data.

19. A non-transitory computer-readable recording medium storing a voice synthesis program, the voice synthesis program comprising instructions that, when executed by a computer, cause the computer to:

generate sequence data SeqDi including a plurality Pkp of kinds of parameters for controlling vocalization of a voice to be synthesized based on music information and lyrics information;

output a singing voice SVi based on the sequence data SeqDi;

acquire a plurality Ppci of pieces of processing content information in response to a single piece SMI1 of singing manner information specified by a user, the plurality Ppci associated with the single piece SMI1 among a plurality Ppsmi of pieces of preset singing manner information, and wherein each piece PCIx of the plurality Ppci of pieces of processing content information indicates respective contents Cepx of edit processing for all or part of the plurality Pkp of kinds of parameters;

generate a plurality Ppsd of pieces of sequence data based on the acquired plurality Ppci of pieces of processing content information, wherein each piece SeqDpx of the plurality Ppsd of pieces of sequence data is generated by editing, based on a respective piece PCIx, all or part of the plurality Pkp of kinds of parameters included in the sequence data SeqDi according to respective contents Cepx, such that the plurality Ppsd of pieces of sequence data are generated based on the plurality Ppci of pieces of processing content information acquired in response to the single piece SMI of singing manner information, which is specified by the user, among the plurality Ppsmi of pieces of preset singing manner information.

* * * * *